US008607712B2

(12) United States Patent
Herzog et al.

(10) Patent No.: US 8,607,712 B2
(45) Date of Patent: Dec. 17, 2013

(54) SYSTEM FOR GUIDING RAILS ON A RAIL TRAIN

(75) Inventors: Stanley M. Herzog, St. Joseph, MO (US); Ivan E. Bounds, St. Joseph, MO (US)

(73) Assignee: Herzog Contracting Corp., St. Joseph, MO (US)

( * ) Notice: Subject to any disclaimer, the term of this patent is extended or adjusted under 35 U.S.C. 154(b) by 239 days.

(21) Appl. No.: 13/023,975

(22) Filed: Feb. 9, 2011

(65) Prior Publication Data

US 2012/0199038 A1 Aug. 9, 2012

(51) Int. Cl.
*E01B 29/17* (2006.01)
*B61D 3/16* (2006.01)

(52) U.S. Cl.
USPC ..... 105/355; 105/404; 104/2

(58) Field of Classification Search
USPC ..... 104/2, 7.1, 7.2; 105/355, 238.1, 404; 410/44, 47; 238/127, 128; 414/339, 414/498, 529, 537, 746.6, 745.1
See application file for complete search history.

(56) References Cited

U.S. PATENT DOCUMENTS 1,091,323 A * 3/1914 Fox ..... 238/127
3,266,577 A 8/1966 Turner
3,288,082 A 11/1966 Brosnan
5,297,482 A 3/1994 Cleveland
5,520,497 A 5/1996 Hertelendi et al.
5,630,365 A 5/1997 Hertelendi
5,762,464 A 6/1998 Hertelendi
7,350,467 B2 * 4/2008 Green et al. ..... 104/7.1
7,370,586 B2 5/2008 McHale et al.
2008/0163781 A1 7/2008 Green et al.

FOREIGN PATENT DOCUMENTS

EP 0752499 A1 1/1997
EP 1388479 A1 2/2004

OTHER PUBLICATIONS

Photographs of guide shoe for guiding rails loaded onto a rail train in public use prior to invention herein.
Translation of Extended European Search Report for EP application No. 11157354.9, dated Mar. 27, 2012.

* cited by examiner

*Primary Examiner* — Mark Le
(74) *Attorney, Agent, or Firm* — Erickson, Kernell, Derusseau & Kleypas, LLC

(57) ABSTRACT

A system for guiding rails onto a rail train having rail cars with a plurality of vertically spaced rail support shelves includes upwardly opening guide channels extending from funnel members position at the end of the rail car to each shelf in alignment with the outermost rail receiving pockets of each shelf. A guide shoe with a horizontal roller recessed therein and projecting below the bottom of the shoe is mounted on the end of a rail threaded across the shelves and guide channels of the rail support car. An alternative guide shoe further includes vertically extending rollers projecting from the sides of the guide shoe.

12 Claims, 10 Drawing Sheets

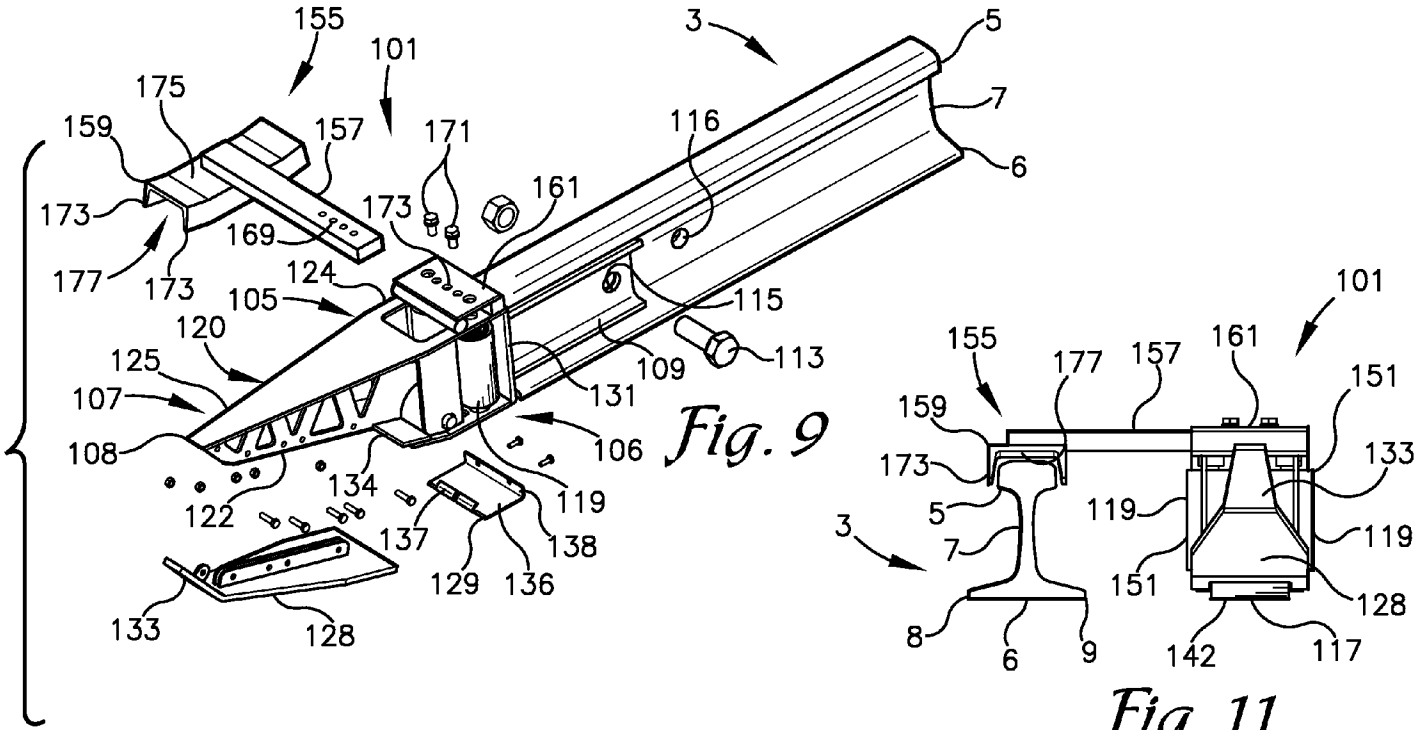
Fig. 9
Fig. 11
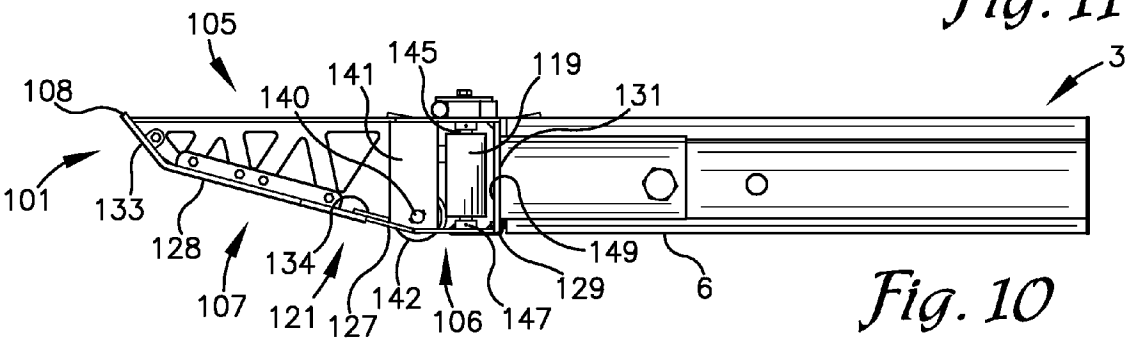
Fig. 10

SYSTEM FOR GUIDING RAILS ON A RAIL TRAIN

BACKGROUND OF THE INVENTION

1. Field of the Invention

This invention relates to apparatus to facilitate the loading of railroad ribbon rails on rack cars of a rail train and in particular guides for guiding ribbon rail onto shelves of the rack cars and shoes for guiding the front end of the ribbon rail therethrough.

2. Description of the Related Art

Modern railroad tracks are constructed using long sections of ribbon rail which presently may be up to 1600 feet in length. These sections of ribbon rail are formed by butt welding multiple sticks of rail, which traditionally come from the steel mill in thirty-nine foot or seventy-eight foot lengths. The welding of the ribbon rails is done at a welding plant and the welded ribbon rails are transported to their installation site on a specially constructed rail train. The rail trains include a plurality of rack cars or rail rack cars, each typically having two racks of shelves.

Prior art rail trains traditionally comprise of a plurality of 60 foot rack cars connected together by standard railroad couplers. Each car includes a pair of transverse stands for supporting the ribbon rail. The stands of each car are spaced 30 feet apart and 15 feet from the respective coupler such that the stands are spaced 30 feet apart along the length of the rail train. The stands each include multiple tiers or shelves (typically five or six tiers) which each tier supporting a plurality of rails (for example eight to twelve rails per tier). The space in which an individual stick of rail is supported on each shelf may be referred to as a pocket. The stands must each be strong enough both to support the weight of the rails and to resist side loads created by flexing of the ribbon rails as the rail train traverses curves in the track. Sidewalls of each stand constrain the rails on the shelves. Thirty foot spacing for the stands is believed to be optimal for supporting the rails without excessive sagging.

One car in each rail train is a tie-down car including a specialized stand which includes means for fixing the rails to the racks to prevent longitudinal movement of the rails relative to the tie-down car. All the other racks in the train allow for relative longitudinal movement of the rails and may include rollers which support the rails. This relative movement between the racks and the rails is required in order to allow the rails to flex without stretching or compressing as the train traverses curves in the track, as well as to allow for coupler slack that exists in each of the couplers between cars.

The rails are loaded or threaded onto the rail train and across the shelves of the racks by a powered drive system. Considerable effort is required to carefully thread each rail into a desired pocket on each shelf. Loading the first rail on each shelf is the most difficult as it is difficult to thread the rail through the desired outer pocket of each rail support shelf, particularly when the rail train is setting on a curved section of track as the end of the rail wants to move in a straight line and the front end tends to sag. A common practice to assist in guiding a rail through the selected pocket on the rack car shelves is to mount a pointed shoe on the end of each rail, but it is still difficult to keep the stick of rail traveling in a curved path if the train is curved. Once the first rail is loaded on each self a guide arm can be attached to a shoe mounted on the leading end of the next rail to be loaded with the guide arm having a receiver positioned over the head of the previously loaded rail to slide therealong as the next rail is loaded so as to guide the end of the rail being loaded in alignment with the desired pocket of each shelf and to maintain proper spacing between the rail being loaded and previously loaded rail. Because there is not a previously loaded rail to use in guiding the second rail in place, workers may have to use pry bars and the like to redirect the end of the rail through the desired pockets and prevent the end of the rail being loaded to extend outside of the sidewall of the support rack across which it is being loaded.

There remains a need for an improved system for guiding rails being loaded onto the cars of a rail train and in particular onto the rail rack cars of a rail train.

SUMMARY OF THE INVENTION

A rail car for a rail train includes upwardly opening guide channels for supporting and guiding rails being loaded onto the car into alignment with aligned pockets on shelves of a shelf rack on the rail car. The guide channels extend between vertical supports or inwardly angled funnel members mounted on opposite sides of the rail car base near an end thereof and selected pockets of the shelves of the rail car. Each said guide channel has a floor which is wider than a base of the rail adapted to be supported on the shelf. In a preferred embodiment, a rail support car or rack car includes two racks of shelves spaced inward from first and second ends of the rack car and funnel members extending upward from each end of the rack car on opposite sides thereof with a single guide channel extending between an outer pocket of each shelf and the funnel member positioned on the same end of the rack car. The first rail loaded onto each shelf is guided into a selected outer pocket by the funnel member and guide channel associated with that pocket.

A shoe, attached to the front of the rail and having a horizontal roller recessed within the base of the shoe, facilitated threading the rail through aligned pockets of successive shelves of the cars in the rail train. The horizontal roller facilitates advancement of the shoe across the web of the guide channel. The shoe may also include vertical rollers to facilitate movement of the roller across any vertically extending surfaces.

After the first shoe is loaded onto the shelf, a rail spacing guide is attached to the shoe of the next rails to be loaded. The spacing guide includes a downwardly opening channel member on a guide arm connected to the shoe which engages the head of a previously loaded rail to guide the next loaded rail in the proper spacing through the next set of aligned pockets of the successive shelves in the rail train.

BRIEF DESCRIPTION OF THE DRAWINGS

FIG. 9 is an enlarged and exploded perspective view of a guide shoe attached to an end of a fragmentary section of rail, the guide shoe having horizontal and vertical rollers recessed therein and a rail spacing guide extending out one side thereof.

FIG. 10 is a side plan view showing a guide shoe attached to an end of the fragmentary section of rail.

FIG. 11 is front plan view of the guide shoe as in FIG. 9 showing a guide channel of the rail spacing guide secured over the head of an adjacent rail shown in cross-section.

DETAILED DESCRIPTION OF THE PREFERRED EMBODIMENTS

Figure 1:
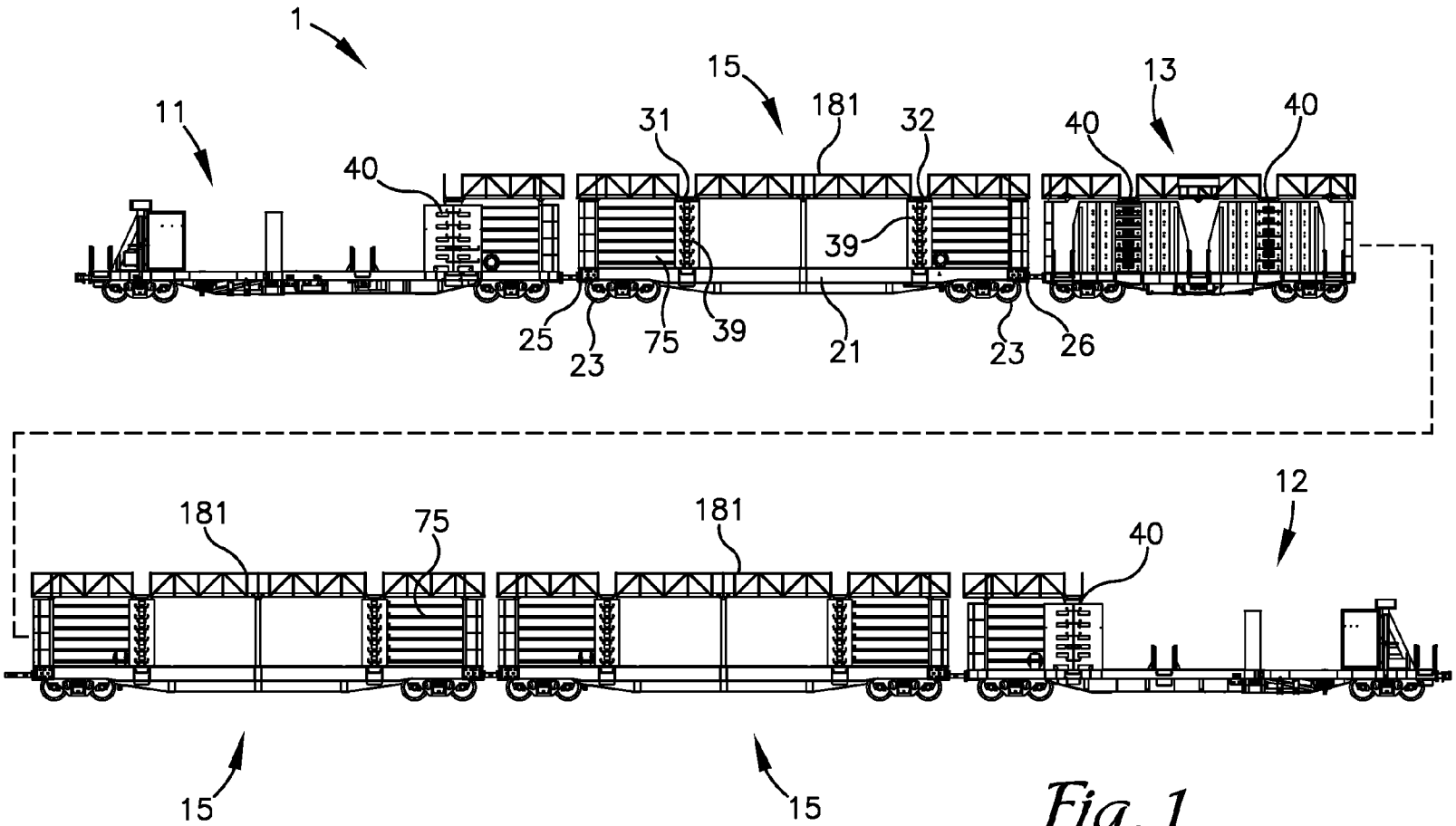
FIG. 1 is a partially schematic side view of a rail train having end cars at either end, a tie down car near the middle and a plurality of rail support cars for supporting multiple ribbon rails thereon.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a rail train. The train 1 is adapted for transporting a plurality of ribbon rails 3 along a railroad track (not shown). Each rail 3, see FIGS. 7 and 9, includes a head 5, a base or base flange 6 and a web 7 connecting the base flange 6 to the head 5. The base flange 6 may be described as including opposingly directed feet 8 and 9. Referring to FIG. 1, the rail train 1 is made up of a plurality of cars 10, including front and rear end cars or tunnel cars 11 and 12, a tie-down car 13 and a plurality of rail support cars or rack cars 15. The train 1 is pulled along the track by one or more locomotives (not shown).

Figure 2:
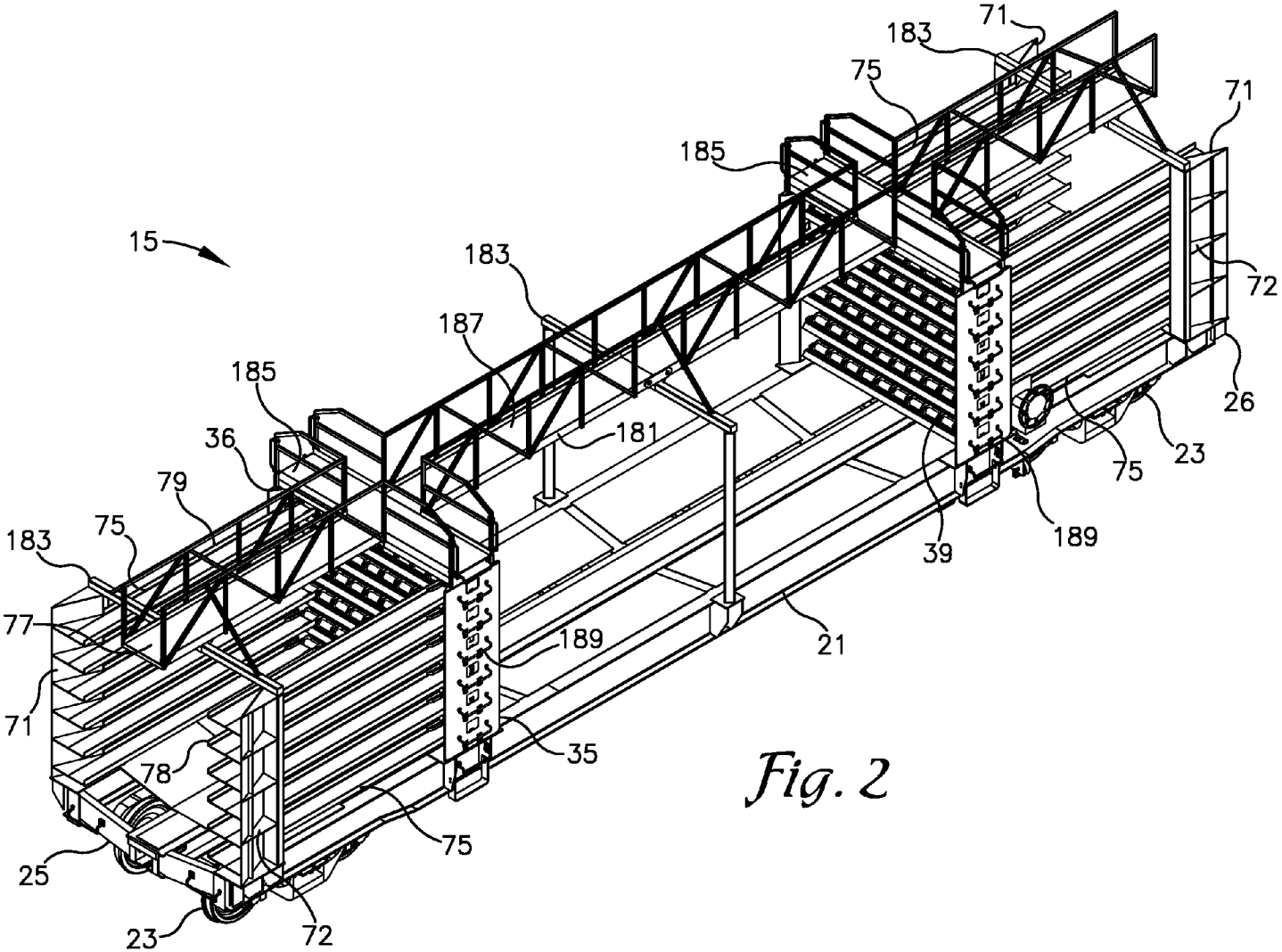
FIG. 2 is an enlarged perspective view of a rail support car incorporating guide channels extending between shelves of the rail support car and funnel members on the sides of the ends of the rail support car and having a cat walk extending the length of the rail support car above the shelves.
Figure 3:
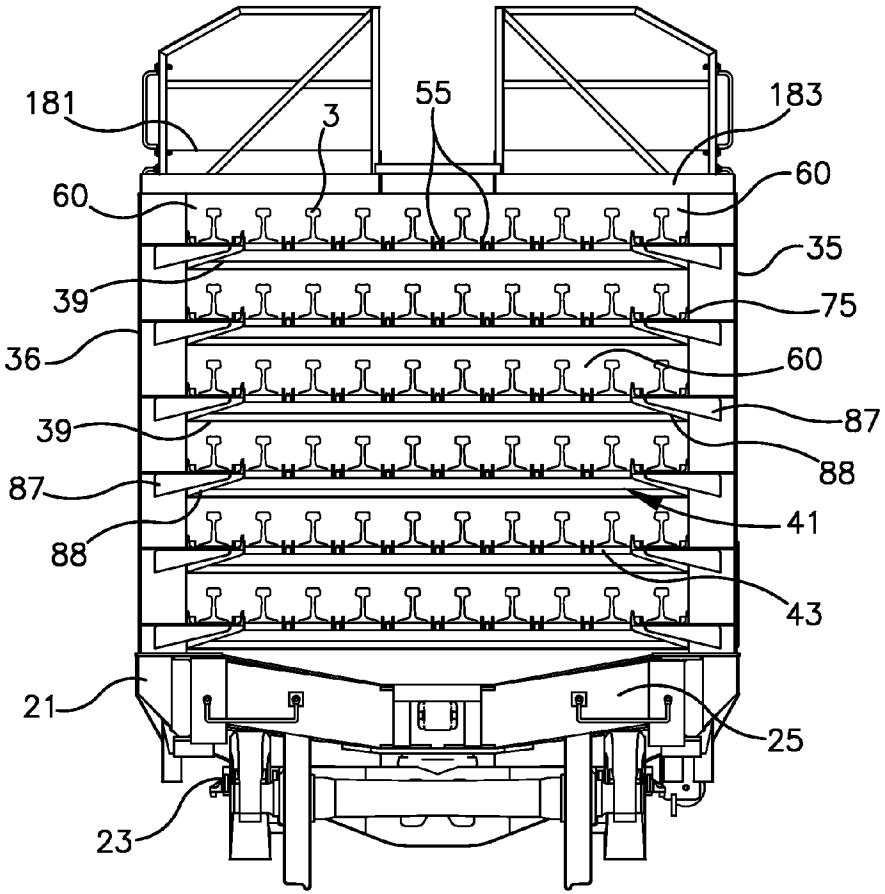
FIG. 3 is an end view of the rail support car showing rails supported in each of the pockets on all of the shelves.

Referring to FIGS. 1-3, each rack car 15 includes a rail car base 21 supported on a pair of trucks or bogies 23 positioned near first and second ends 25 and 26 thereof. First and second racks or stands 31 and 32, for supporting rails 3 loaded on the rail train 1, extend upward from the rail car base 21 in inwardly spaced relation from the first and second ends 25 and 26 respectively. Each rack 31 and 32 is positioned inward from a corresponding rail car base end 25 and 26 approximately one quarter of the length of the rail car base 21.

As best seen in FIGS. 1-4, each rack includes a pair of sidewalls 35 and 36 extending upward from the rail car base 21 on opposite sides thereof and a plurality of shelves 39, six in the embodiment shown, extending between the sidewalls 35 and 36 in vertically spaced alignment. It is to be understood that each of the other cars 10 in the rail train 1 includes some form of shelves or shelving 40 supported in a corresponding vertical spaced alignment as shelves 39 of rack cars 15 for supporting the rails 3 at a desired support spacing generally across the entire length of the train 1.

As best seen in FIGS. 3-6, each shelf 39 is formed by a framework 41 supporting a plurality of flanged rollers 43, ten in the embodiment shown, between the sidewalls 35 and 36. The framework 41 comprises a pair of lateral struts 45 extending between and mounted to the sidewalls 35 and 36. Roller support struts 47, eleven in the embodiment shown, are connected to and extend between the lateral struts 45, longitudinally relative to the railcar base 21. Each roller 43 comprises a cylindrical roller body 51 mounted on a roller shaft 53 with flanges 55 formed on each end of the roller body 51 and projecting radially outward therefrom. The roller body 51 and the spacing between the flanges 55 on either end thereof is slightly wider than the base 6 of a rail 3 to be supported thereon. Ends of each roller shaft 53 are mounted to and supported on a roller support strut 47 by a bearing assembly 57 such that the roller shafts 53 extend transverse relative to the length of the rail car base 21.

Referring to FIG. 3, the area extending between the flanges 55 on each roller 43 and between the roller 43 and the shelf 39 spaced thereabove, defines what may be referred to as a pocket 60 for receiving a rail 3. The number of pockets 60 corresponds to the number of rollers 43 supported on each shelf 39. It is foreseen that each shelf 39 could be formed simply as a planar support surface across which the rails 3 slide and not with separate rollers or the like or structure defining separate spaces or pockets for each rail 3. In such an embodiment, the two outermost areas of each shelf in which the outermost rails 3 are supported may still be referred to as a pocket.

Each shelf 39 also includes upward angling ramps 63 extending between the sidewalls 35 and 36 in front of each lateral strut 45 to urge the end of a rail 3 being loaded onto the shelf 39 upwards and onto the desired roller 43. Guide plates 65 and 66 are mounted to each sidewall 35 and 36 of each rack 31 and 32 and angle inward from an outer edge of each sidewall 35 and 36 toward the outermost roller support strut 47 and roller 43 mounted thereon to help laterally guide the end of a rail 3 being loaded through an outermost pocket 60 onto the outermost roller 43.

Opposed funnel members or plates 71 project upward from the rail car base 21 on opposite sides thereof proximate the first and second ends 25 and 26 thereof. Each funnel member 71 extends upwards at generally the same height as the sidewalls 35 and 36 of each rack 31 and 32. The funnel members 71 angle inward from the associated end 25 or 26 of the rail car base 21 toward the associated rack 31 or 32. The funnel members 71 function to guide the ends of rails 3 being threaded through the outermost pockets 60 of the shelves 39 inward toward the pockets 60 and to restrain the ends of the rails 3 from advancing outward of the associated sidewall 35 or 36. Bracing 72 supports the funnel members 71 in the desired vertical alignment.

Upward opening guide channels 75 are connected to and extend generally horizontally from each funnel member 71 to an adjacent shelf 39 in alignment with an outermost pocket 60 of the shelf, such that two guide channels 75 extend between each pair of opposed funnel members 71 and each shelf 39 on opposite ends thereof. In the embodiment shown, with six shelves 39 per rack 31 and 32, twelve guide channels 75 extend between opposed funnel members 71 and the six shelves 39 in each rack 31 and 32. The funnel members 71 may also function as vertical supports for the outer ends of the guide channels 75.

Each guide channel 75 includes a guide channel floor, base or web 77 and inner and outer side walls or flanges 78 and 79 projecting upward from the floor 77. The outer side wall 79 of each guide channel 75 extends from an inner edge of each funnel plate 71 to an end of the guide channel 75 proximate the outer pocket 60 of the shelf 39. The inner side wall 78 of the guide channel 75 extends from an end 25 or 26 of the rack car base 21 to an opposite end of the guide channel 75 proximate the outer pocket 60 of the shelf 39. The guide channel floor 77, between the inner and outer side walls 78 and 79 is preferably selected to be approximately one and a half times or twice as wide as the base 6 of a rail 3 to be supported or guided thereby. The floor 77 of each guide channel 75 at the outer end thereof adjacent the associated funnel plate 71 angles outward, following the angle of the funnel plate 71 and is typically three to four times as wide as the base 6 of a rail 3.

Figure 4:
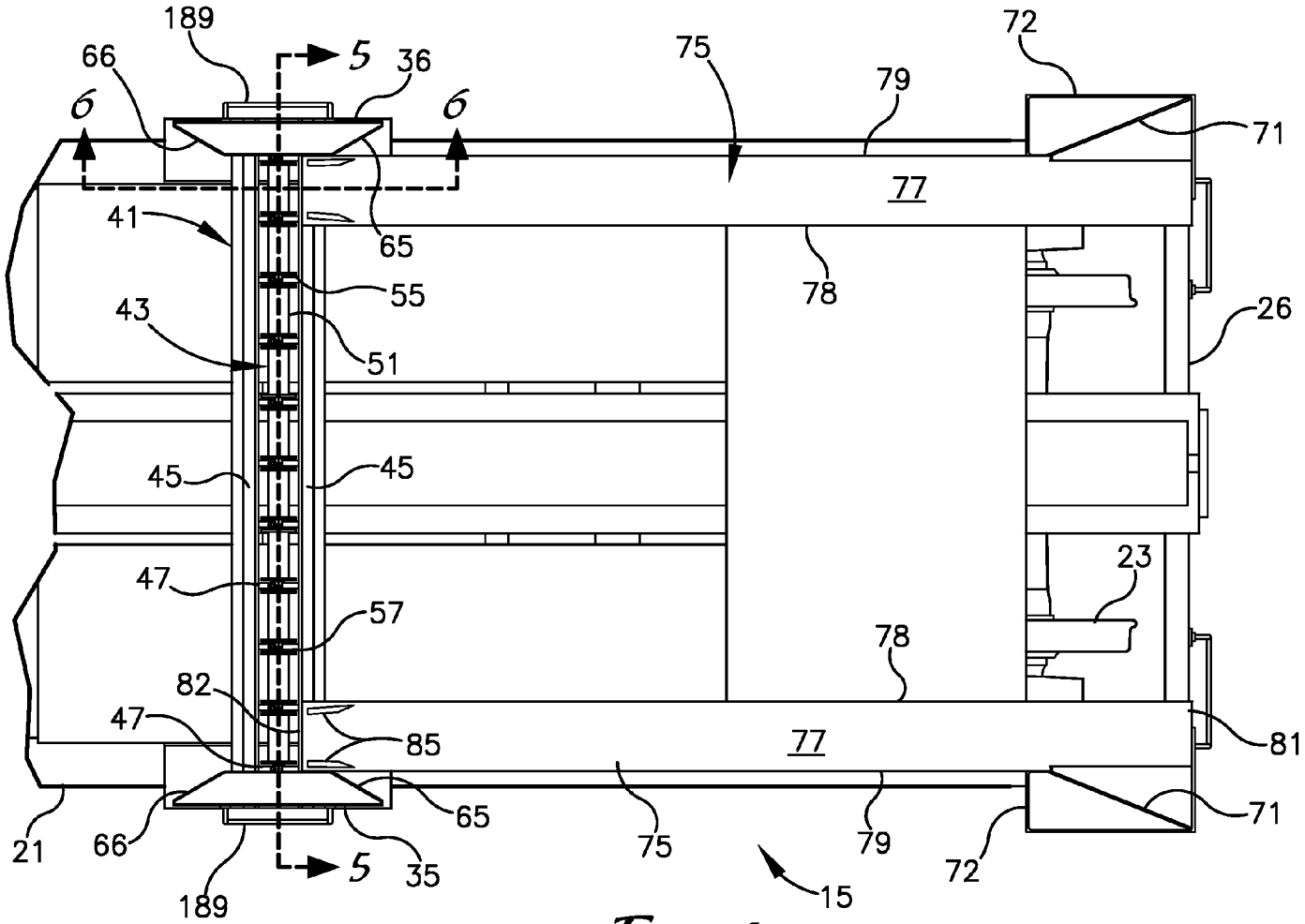
FIG. 4 is an enlarged and fragmentary top plan view of one of the rail support cars with the cat walk removed to show details of a rail support shelf and the guide channels associated therewith.
Figure 5:
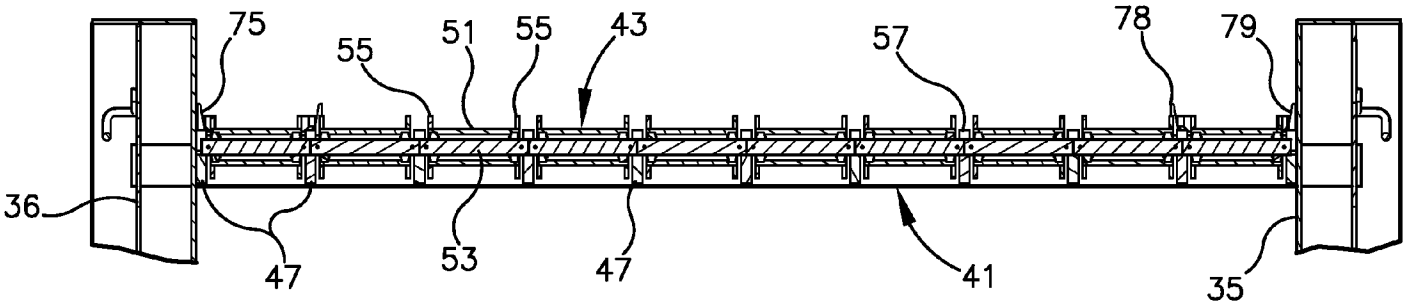
FIG. 5 is an enlarged and fragmentary cross-sectional view taken along line 5-5 of FIG. 4.
Figure 6:
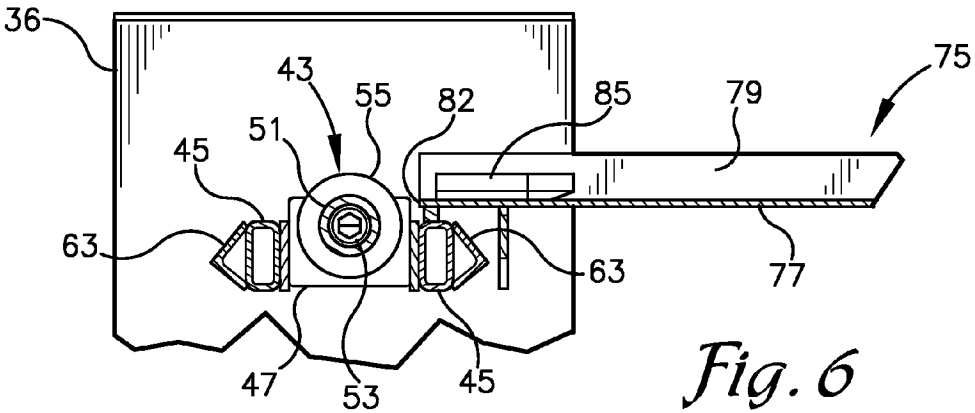
FIG. 6 is an enlarged and fragmentary cross-sectional view taken along line 6-6 of FIG. 4.

Referring to FIG. 6, an inner end 82 of each guide channel 75 is welded to and supported on an outer lateral strut 45 of the roller support framework 41 of each shelf 39. The inner end 82 of each guide channel 75 is thereby positioned in close proximity to an aligned roller 43 of the associated outer pocket 60 and the upper surface of the guide channel floor 77 is spaced just slightly below an upper circumferential edge of the aligned roller 43. As seen in FIG. 4, each guide channel 75 is slightly wider than a roller 43 but not so wide as to overlap with the roller body 51 of the adjacent roller 43 so as not to impede threading of a rail 3 there across. Inwardly sloping or angled guide members or restrictors 85 are mounted in each guide channel 75 proximate the inner end 82 thereof and on top of the floor 77 to restrict the width of the outlet therefrom and guide the end of a rail 3 between the flanges 55 of the aligned roller 43.

Each guide channel 75 is supported by first and second support brackets 87 and 88. The first support bracket 87 is welded to and projects inward from the funnel member 71 to which the channel 75 is connected and the second support bracket 88 is welded to and projects inward from the sidewall 35 or 36 to which the channel 75 is connected.

A rail 3 being loaded onto the racks 31 and 32 in alignment with an outer pocket 60 associated with each rack 31 and 32 is supported on the guide channel 75 as it is slid through each pocket 60 of the associated shelf 39. The guide channel side walls 78 and 79 generally restrain the rail 3 from flexing outward from the selected outer pocket 39 and help guide the rail 3 through the selected outer pocket 60 with the guide members 85 guiding the end of the rail over the aligned roller 43 between its flanges 55. The width of the guide channels 75 and the angle of the funnel members 71 do allow the rails 3 supported on the guide channels 75 to flex or curve an adequate amount as the rail rack cars 15 move around a curve in the tracks.

Figure 7:
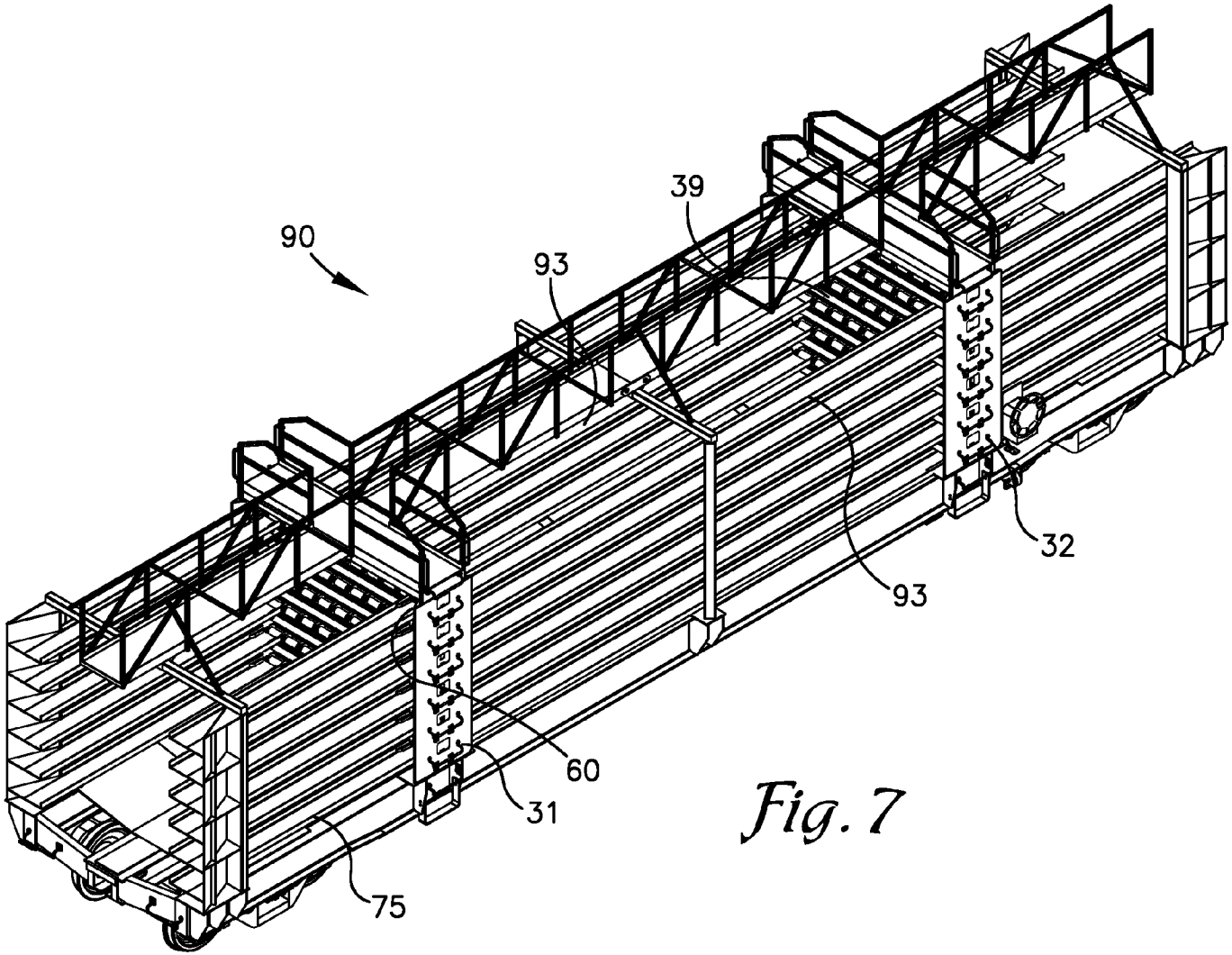
FIG. 7 is an enlarged perspective view of a first alternative embodiment of a rail support car incorporating guide channels extending between shelves of the rail support car and funnel members on the sides of the ends of the rail support car and having guide channels extending between the shelves of the rail support car in alignment with the outermost pockets of each shelf.
Figure 8:
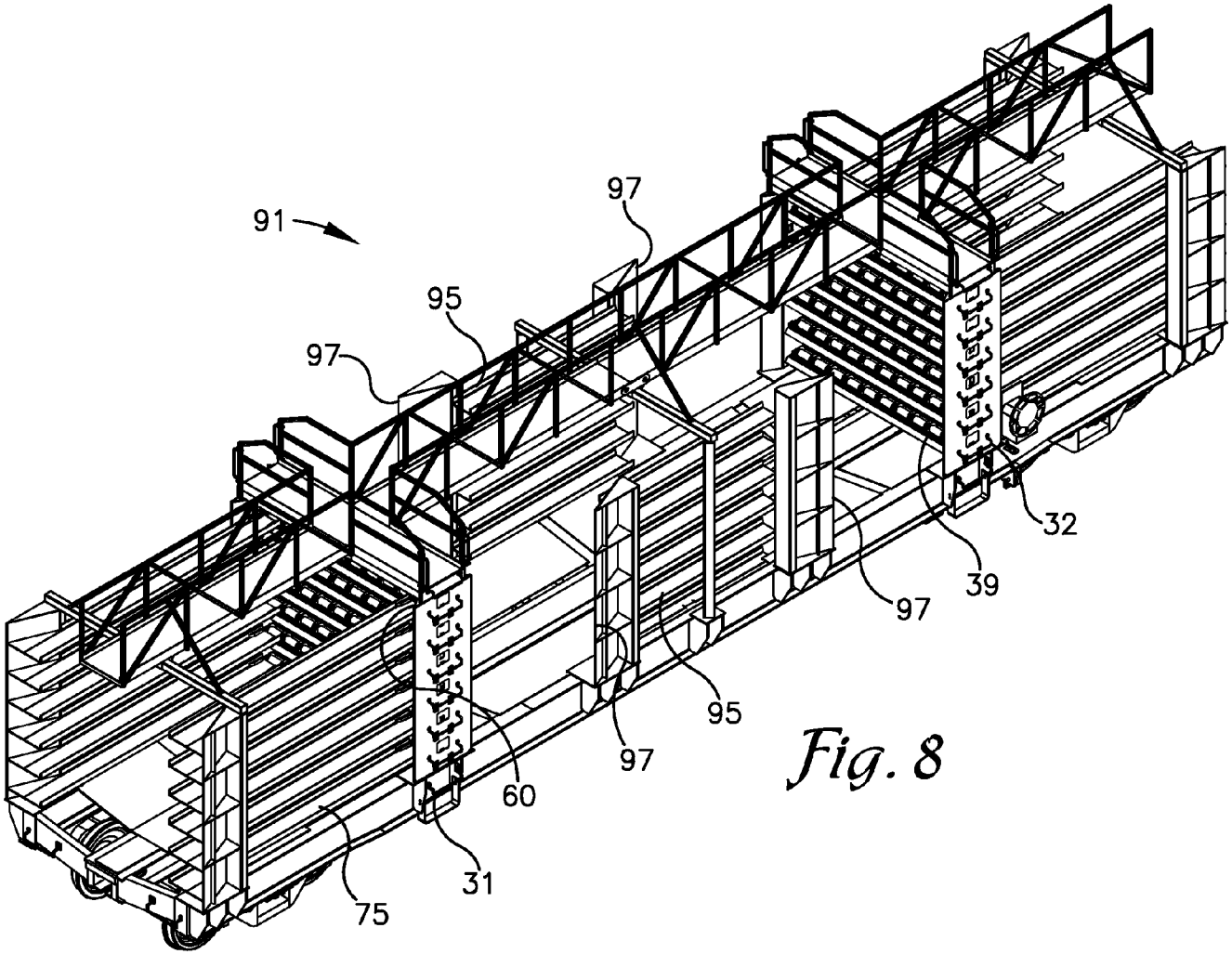
FIG. 8 is an enlarged perspective view of a second alternative embodiment of a rail support car incorporating guide channels extending between shelves of the rail support car and funnel members on the sides of the ends of the rail support car and having guide channels extending partially between the shelves of the rail support car in alignment with the outermost pockets of each shelf.

FIGS. 7 and 8 show alternative embodiments of rail support cars or rail rack cars 90 and 91 respectively. Structure of rail support cars 90 and 91 corresponding to similar structure in rail support cars 15 are identified with the same reference numbers. In rail support car 90, guide channels 93, constructed similar to guide channels 75, extend between or span the distance between each rack 31 and 32 of the rack car 90 in alignment with the outer pockets 60 of each shelf 39. The guide channels 93 may be supported along their length by support brackets (not shown) associated with the framework supporting the catwalk of the rail support car. In rail support car 91, guide channels 95 span part of the distance between the racks 31 and 32 in alignment with the outer pockets 60 of each shelf 39. The ends of the guide channels 95 are supported by funnel plate assemblies 97 mounted on the sides of the rail support car 91. The embodiment of the rail support car 91 may be preferred over the embodiment of rail support car 90 to meet weight limitations.

Figure 13:
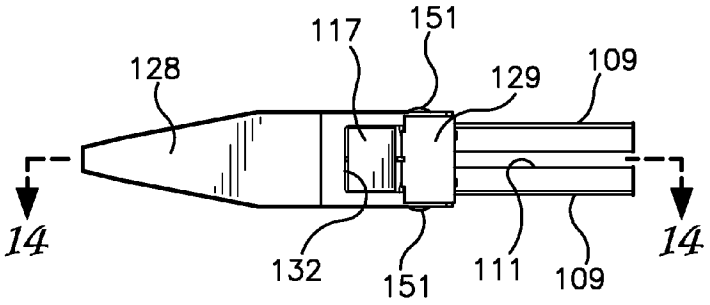
FIG. 13 is a bottom plan view of the guide shoe as in FIG. 12.

Referring to FIGS. 9 and 10, a rail guide shoe 101 is attached to the front of each rail 3 loaded onto rail train 1 to facilitate threading the rail 3 through the rail train 1 including through the selected, aligned pockets 60 associated with the racks 31 and 32 of each rack car 15. Each shoe 101 includes a shoe body 105, having a heel 106, a toe 107 projecting forward from the heel 106 in an inward taper to a blunt tip 108 and a pair of mounting legs 109 projecting rearward from the heel 106 in spaced apart relation to form a gap 111 therebetween. The gap 111, as best seen in FIG. 13, is sized to receive the web 7 of a rail 3 at the leading end thereof with the legs 109 extending on opposite sides of and in closely space relation to the web 7 between the head 5 and base 6 of the rail 3. Each shoe 101 is bolted to an end of a rail 3 using a bolt 113 extending through holes 115 in the legs 109 aligned with a hole 116 in the web 7 of the rail 3.

Referring to the embodiment of the guide shoe 101 shown in FIGS. 9-14, a horizontal roller 117 is rotatably mounted within and projects slightly below the shoe body 105 preferably at the interface between the toe 107 and heel 106. It is foreseen that the horizontal roller 117 might be positioned only within the heel 106 or only within the toe 107. A pair of vertical rollers 119 are rotatably mounted within and project outward from sides of the shoe body heel 106. The vertical rollers 119 could be positioned further forward so as to generally extend at the interface between the heel 106 and toe 107 of the shoe body 105. The horizontal roller 117 preferably is sized to extend across a substantial portion of the width of the heel 106 of the shoe 101 and the vertical rollers 119 are sized to extend across a substantial portion of the height of the heel 106. It is to be understood that the shoe 101 might only include a horizontal roller 117 as in the embodiment shown in FIG. 15. The comparable components of the two embodiments of the shoes shown are numbered consistently.

In the embodiments shown, the shoe body 105 is formed from steel plates welded together and the legs 109 are formed from rectangular channel members welded to the heel 106. It is to be understood that the shoe body 105 could be cast as a single casting and then machined to provide recesses for receiving the rollers 117 and 119.

Shoe body 105, as shown in FIGS. 9-14, includes a planar, top plate 120, a base plate assembly 121 and an interconnecting web 122 extending between the top plate 120 and the base plate assembly 121. The top plate 120 forms an upper surface of both the heel 106 and toe 107 and may be described as being divided into a heel portion 124 and a toe portion 125. The base plate assembly 121, includes base plate 127, front or toe skid plate 128 and rear or heel skid plate 129. A back plate 131 extends between the top plate 121 and the base plate 127 at the rear of the shoe body heel 106. A roller opening 132 is formed in the base plate 127 at the interface between the heel 106 and toe 107 portions of the shoe body 105 such that the opening 132 extends through both portions thereof. Holes may be formed in the web 122 and other portions of the plates forming the shoe body 105 to reduce its overall weight.

The toe skid plate 128 is removably securable, by bolting to the interconnecting web 122 and angles upward and forward from the heel 106 to or just past the distal end of the top plate 120 at the tip 108 of the shoe 101. The toe skid plate 128 as shown includes an upturned portion 133 proximate the distal end thereof so that the tip 108 of the shoe 101 angles upward relative to the rest of the toe skid plate 128. Both the toe portion 125 of the top plate 120 and the toe skid plate 128 narrow or taper inward toward the tip 108 of the shoe 101 to form a bluntly pointed toe 107. When secured in place, an inner end of the toe skid plate 128 abuts against a support plate 134 welded to an inner surface of the base plate 127 so as to extend partially past an edge of the base plate 127 closest to the tip 108 of the toe 107.

As best seen in FIGS. 9-14, the heel skid plate 129 includes a horizontal wear plate 136 that covers the base plate 127 between the roller opening 132 and the back plate 131 and front and rear mounting flanges 137 and 138. Front mounting flanges 137 extend upward into the horizontal roller opening 132 and into overlapping relationship with a rear edge thereof. The rear mounting flange 138 extends flush with or in abutment with a rear surface of the back plate 131 and is bolted thereto s that the heel skid plate 129 is removably securable to the heel 106 of the shoe body 105 with the horizontal wear plate 136 extending over the portion of the base plate 127 extending rearward from the roller opening 132.

The toe skid plate 128 and heel skid plate 129 are adapted to be replaceable due to wear. It is foreseen that the toe skid plate 128 could be integrally formed with the base plate 127 and have wear ribs or the like formed thereon which could be rebuilt after wearing down. Similarly wear ribs or the like could be formed on the base plate 127.

When the shoe 101 is bolted to a rail 3, the bottom surface of the base plate 127 extends generally in planar alignment with the bottom surface of the rail base 6 and in closely spaced relation thereto. The heel skid plate 129 preferably extends below the bottom surface of the rail base 6. The upward and forward slope of the toe skid plate 128 urges the end of the rail 3 upward as the toe skid plate 128 engages horizontal edges such as the ramps 63 of each shelf 39 to ensure that the end of the rail 3 is raised into proper vertical alignment with the surfaces over which it is to be slid such as rollers 43.

The horizontal roller 117 is mounted on a shaft 140 which is supported on and extends between vertical supports 141 extending between the top plate 120 and base plate 127 on opposite sides of the shoe body 105. The horizontal roller shaft 140 is supported above the opening 132 such that a lower circumferential edge 142 extends below the base plate 127, the heel skid plate 129 and the toe skid plate 128. An axis of the horizontal roller 117 extends generally horizontally and transverse to a direction of travel of the shoe 101. Most of the horizontal roller 117 extends within the shoe body 105 and may be described as being recessed therein or positioned within a recess in the shoe body 101. A recess 143 is also formed in the web 122 to accommodate the horizontal roller 117. The horizontal roller 117 is preferably of a type having bearings (not shown) integrated therein. Horizontal roller 117 functions to facilitate movement of the shoe 101 across the floor 77 of the guide channels 75, over the ramps 63 and across the lateral struts or supports 45 forming the shelves 39 and any other horizontal structure across which it is advanced to facilitate threading a rail 3 through selected aligned pockets 60 of the successive shelves 39 of the rack cars 15 and other cars of the rail train 1.

The vertical rollers 119 are mounted on shafts 145 supported between the heel portion 124 of top plate 120 and the base plate 127 extending therebelow such that the axis of the vertical rollers 119 generally extend transverse to a direction of travel of said the shoe 101. Each shaft 145 is supported in a bearing 147 connected to the top plate 120 and the base plate 127. A vertical roller gap or opening 149 extends between each vertical support 141 and the back plate 131 of the shoe body 105 through which a portion of the associated vertical roller 119 extends. An outer circumferential edge 151 of each vertical roller 119 extends outward, past outer edges of the top plate heel portion 124 and the base plate 127. Most of each vertical roller 119 extends within the shoe body 105 and may be described as being recessed therein or positioned within a recess in the shoe body 101. The vertical rollers 119 facilitate movement of the shoe 101 relative to the funnel member 71 and any other vertical extending surfaces it may advance against.

Figure 15:
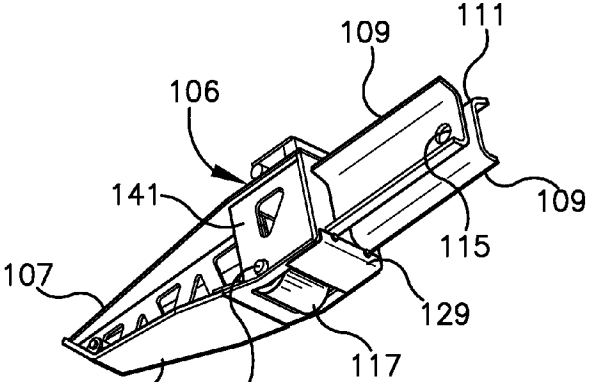
FIG. 15 is a bottom, perspective view of an alternative embodiment of the guide shoe having a horizontal roller but no vertical rollers.
Figure 12:
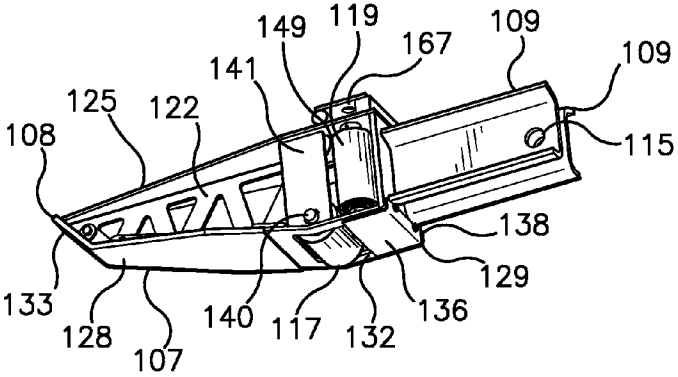
FIG. 12 is a bottom, perspective view of the guide shoe.
Figure 14:
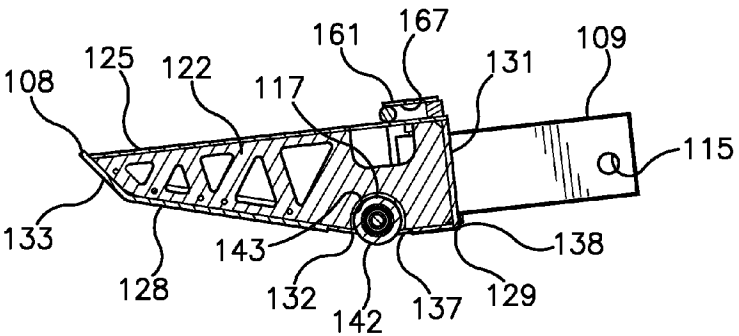
FIG. 14 is a cross-sectional view taken along line 14-14 of FIG. 13.

In the embodiment of the shoe 101, as shown in FIG. 15, having only a horizontal roller 117, the vertical supports 141 which support the horizontal roller shaft 140 preferably extend the complete length and height of the heel 106, without a roller receiving gap formed therein and are connected to the back plate 131.

Figure 16:
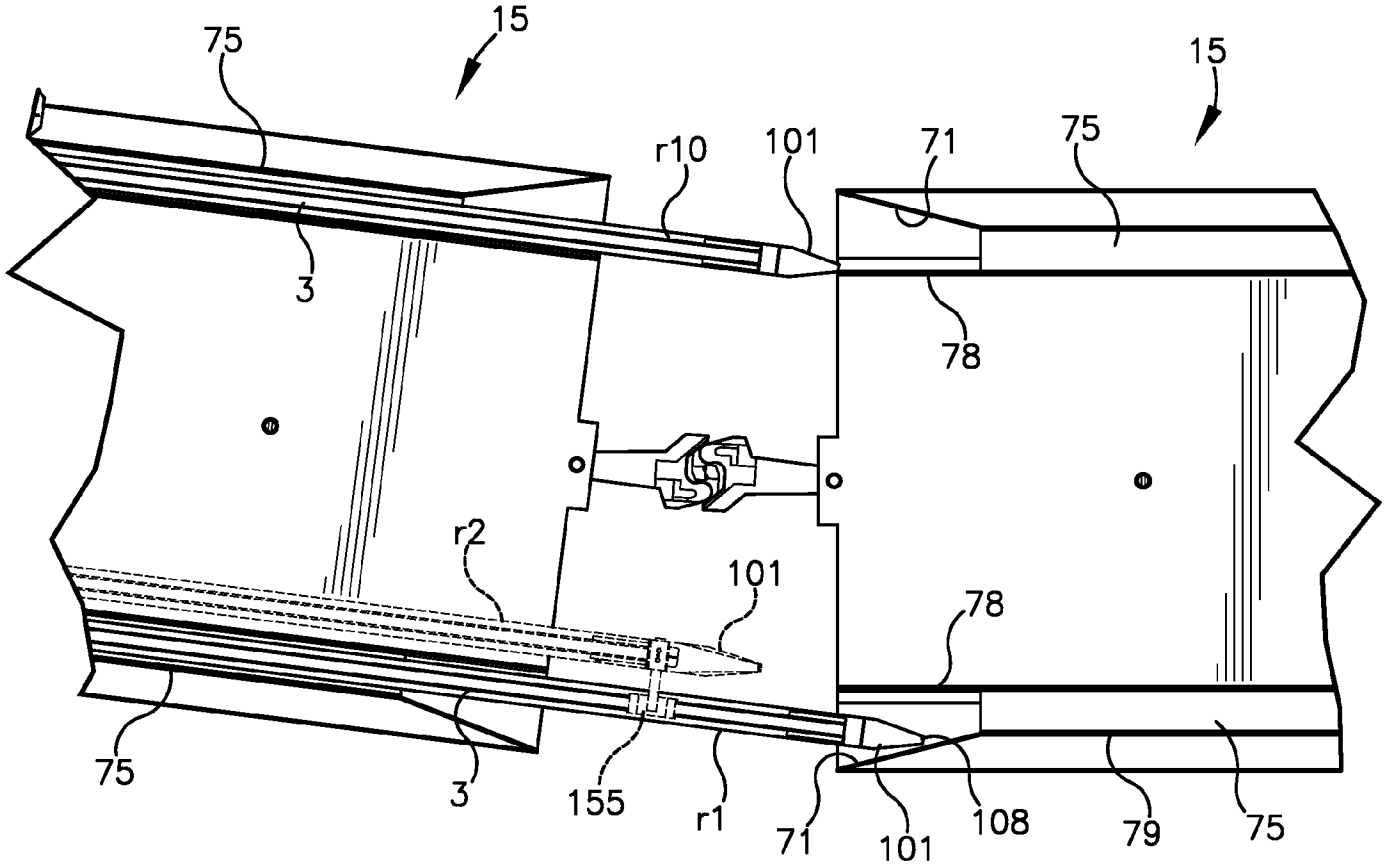
FIG. 16 is an enlarged, top plan view of rails being loaded onto two adjacent rail support cars positioned at an angle relative to each other such as on a curved section of track.

A rail spacing guide 155 including a guide arm 157 and a downwardly opening channel member 159, formed at an outer end of the guide arm 157, is selectively securable to the shoe 101 in a guide arm receiver 161 as shown in FIGS. 9, 11 and 16. The spacing guide 155 is used to guide the shoe 101 and the rail 3 to which it is connected in a selected, desired spacing from a previously loaded rail 3 to facilitate threading the rails 3 in the selected pockets 60. The guide arm receiver 161 is mounted or formed on top of the heel portion 124 of top plate 120 of the shoe body 105. A slot 167, sized to receive the guide arm 157, extends completely through the receiver 161 transverse to the longitudinal axis of the shoe 101 and across the width of the heel 106 of the shoe body 105. The guide arm 157 can be inserted into the receiver slot 167 from either end so that the downwardly opening channel member 159 can be positioned on either side of the shoe body 105. A plurality of threaded, spacing selection holes 169 are formed in the guide arm 157 and are selectively engageable by screws 171, threaded through holes 173 in the top of the receiver 161 to allow adjustment to the spacing of the channel member 159 from the shoe body 105.

The channel member 159 includes a pair of flanges 173 projecting downward from and connected together by a web 175 and forming a downwardly opening channel 177 therebetween. The flanges 163 are spaced apart a distance sized to receive the head 5 of a rail 3 therebetween. The channel member 159 is mounted transverse to the guide arm 157 at an outer end thereof, such that when the guide arm 157 of the rail spacing guide 155 is secured in the receiver 161, the channel 177 extends in parallel alignment with the rail 3 to which the shoe 101 is attached.

In loading the first rail r1 on each set of shelves 39 and 40 of the cars 10 of a rail train 1, a guide shoe 101, without the rail spacing guide 155 is secured to the leading end of the rail 3. The shoe 101 and the end of the rail r1 to which it is attached is positioned or aligned to be threaded through the outermost pockets 60 on either end or side of the vertically aligned shelves 39 and 40 of the cars 10 in the rail train 1. The rail r1 is then threaded through the selected set of pockets 60 on the aligned shelves 39 and 40 of the cars 10. Referring the FIG. 16, when the rail train 1 is resting on a curve, and a rail r1 is being loaded through pockets 60 positioned on the outer side of the curve, as the end of the rail r1 is advanced from the end of one rack car 15 to the front of the next, the end of rail r1 being loaded will try to move in a straight line and outward from the sidewall 35 or 36 supporting the shelf 39. Engagement of the end or tip 108 of the shoe 101 against the outwardly flared funnel member or plate 71 at the end of rack car 15 directs the shoe 101 and attached rail 3 onto the corresponding outermost guide channel 75. The sidewalls 78 and 79 of the guide channel 75 then help guide the shoe 101 and end of rail 3 in proper alignment to the selected shelf pocket 60 and over the corresponding flanged roller 43 in the first stand or rack 31 on the rack car 15.

If a rail 3 is being loaded through pockets 60 positioned on the inner side of the curve, such as r10 in FIG. 16, the end of the rail r10 will normally advance inward toward the next rack car 15. Engagement of the end or tip 108 of the shoe 101 against the inner side wall 78 of the guide channel 75 directs the end of the rail r10 onto the corresponding outermost guide channel 75.

Because the end of the rail 3 and shoe 101 tend to move in a straight line and because the pockets 60 for the pair of aligned shelves 39 in each rack car 15 are linearly aligned, guide channels are not believed to be needed between the adjacent racks 31 and 32 of a single rack car 15. Moreover, guide channels 75 are preferably only mounted in alignment with the two outermost pockets 60 on each shelf 39 because once a rail 3 is loaded onto the shelf 39 in either of the outermost pockets 60, the remaining rails 3 can be guided onto the shelves 39 and through the desired pockets 60 in the proper spacing and alignment using the rail spacing guide 155 in association with the guide shoe 101 as generally shown in FIG. 16. FIG. 16, shows a second rail r2 (in phantom lines) being guided into position adjacent the first rail r1. In the preferred embodiment, two guide channels 75 are used per shelf 39 to allow the first rail 3 to be loaded onto the shelf 39 from either side. It is to be understood that normally after a first rail r1 is loaded, the remaining rails are successively loaded in the manner discussed above with respect to rail r2 by guiding along the previously loaded rail 3. In FIG. 16, rail r10 is only shown loaded prior to the intervening rails to show how the shoe 101 guides a rail 3 loaded through pockets on the inner part of the curve.

As noted previously, because the end of the rails 3 tend to move in a straight line guide channels are really only need between funnel members 71 and rack 31 or 32 positioned toward the end of the car 25 or 26 from which the rails 3 are loaded. However, because it is desirable to allow the rack car to be hooked up to the rail train 1 in either direction or because the direction from which the rails 3 will be loaded may not be known, guide channels 75 extend from each shelf 39 of racks 31 and 32 to the adjacent ends 25 and 26 respectively. In this manner, the rack car 15 can be oriented in either direction on the rail train 1 or rails can be loaded from either end thereof to obtain the benefit of the guide channels 75.

It is to be understood that guide channels 75 and funnel members 71 of the type incorporated into the rack cars 15 discussed herein, could also be incorporated into tie down cars 13 or end cars 11 and 12 of the rail train 1 and are shown in the end cars 11 and 12 in FIG. 1.

After the first rail 3 is loaded on a shelf 39, the rail spacing guide 155 is used with the shoe 101 attached to the next rail 3 to be loaded. The position of the guide arm 157 within the receiver 161 is adjusted so that when the channel member 159 is positioned over the head 5 of the first or previously loaded rail 3 the rail 3 which is then being loaded and to which the shoe 101 is attached is spaced away from the previously loaded rail a distance corresponding to the distance between centers of adjacent pockets 60 on each shelf 39 which corresponds to the distance between the centers of adjacent flanged rollers 43 on each shelf 39. As the rail 3 is then loaded the connection of the rail spacing guide 155 between the rail 3 being loaded and the previously loaded rail 3 guides the rail 3 being loaded through the desired set of aligned pockets 60.

Referring again to FIGS. 1 and 2, a cat walk 181 is supported above the racks 31 and 32 on a support frame assembly 183. Lateral runs 185 of the cat walk 181 extend directly over the racks 31 and 32 and are supported between the rack sidewalls 35 and 36. A longitudinal run 187 extends down the middle of the rack car 15 across each lateral run 185 and from end to end 25 and 26 of the rack car 15. An operator can monitor the loading of rails 3 onto the rack cars 15 from the cat walk 181 and take any required action therefrom. Ladder rungs 189 are mounted on the rack sidewalls 35 and 36 to provide access to the cat walk 181.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A car for a rail train comprising:

a) a rail car base supported on opposite ends by rail car trucks;

b) a rail support rack comprising a plurality of shelves supported above the rail car base in inwardly spaced relation to a first end of said rail car base, each shelf including a support surface on which a rail loaded on the rail train is supported;

c) a plurality of upwardly opening guide channels, each said guide channel fixedly coupled to said car and extending from proximate said first end of said rail car toward a respective one of said shelves in alignment with a respective outer pocket associated with the respective one of said shelves; each said guide channel having a floor which is wider than a base of the rail loaded on the rail train and supported on said shelf, said floor terminating adjacent to said support surface of said respective one of said shelves, and said guide channel configured to direct said rail onto said support surface.

2. The car for a rail train as in claim 1 wherein each of said guide channels is supported proximate said first end of said rail car base by a vertical support.

3. The car for a rail train as in claim 2 wherein each of said vertical supports comprises an inwardly angled funnel plate projecting upward from the rail car base and angling inward from the first end of the rail car toward rail support rack.

4. The car for a rail train as in claim 3 wherein said floor of said guide channel flares outward adjacent said funnel plate.

5. The car for a rail train as in claim 2 wherein said upwardly opening guide channels extend from each said vertical support to each of said shelves only in alignment with the outer pockets associated with each shelf.

6. A rail support car for a rail train comprising:

a) a rail car base supported on opposite ends by rail car trucks;

b) first and second rail support racks, each comprising a plurality of shelves supported above the rail car base in inwardly spaced relation to first and second ends of said rail car base; each shelf extending between a pair of sidewalls;

c) inwardly angled funnel plates projecting upward from the rail car base on opposite sides thereof proximate the first and second ends thereof;

d) an upwardly opening guide channel extending from each said funnel plate to one of said shelves in alignment with an outer pocket associated with said respective shelf; each said guide channel having a floor which is wider than a base of a rail adapted to be supported on said shelf.

7. The rail support car as in claim 6 wherein said floor of each said guide channel flares outward adjacent said funnel plate from which said guide channel extends.

8. The rail support car as in claim 6 wherein said upwardly opening guide channels extend from each said funnel plate to each of said shelves only in alignment with the outer pockets associated with each shelf.

9. The rail support car as in claim 6 further comprising a cat walk supported above each of said rail support racks.

10. A car for a rail train comprising:

a rail car base supported on opposite ends by rail car trucks;

a rail support rack comprising a plurality of shelves supported above the rail car base in inwardly spaced relation to a first end of said rail car base;

a plurality of upwardly opening guide channels, each said guide channel extending from proximate said first end of said rail car toward one of said shelves in alignment with an outer pocket associated with a respective one of said shelves; each said guide channel having a floor which is wider than a base of a rail adapted to be supported on said shelf, and each said guide channel being supported proximate said first end of said rail car base by a vertical support that includes an inwardly angled funnel plate projecting upward from the rail car base and angling inward from the first end of the rail car toward rail support rack.

11. The car for a rail train as in claim 10 wherein said floor of said guide channel flares outward adjacent said funnel plate.

12. The car for a rail train as in claim 10 wherein said upwardly opening guide channels extend from each said vertical support to each of said shelves only in alignment with the outer pockets associated with each shelf.

* * * * *